US007655874B2

(12) United States Patent
Akieda et al.

(10) Patent No.: US 7,655,874 B2
(45) Date of Patent: Feb. 2, 2010

(54) INPUT DEVICE AND ELECTRONICS DEVICE

(75) Inventors: Shinichiro Akieda, Shinagawa (JP); Satoshi Sakurai, Shinagawa (JP); Nobuo Yatsu, Shinagawa (JP); Takuya Uchiyama, Shinagawa (JP); Junichi Akama, Shinagawa (JP); Keita Harada, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 262 days.

(21) Appl. No.: 11/545,479

(22) Filed: Oct. 11, 2006

(65) Prior Publication Data

US 2007/0095644 A1 May 3, 2007

(30) Foreign Application Priority Data

Oct. 28, 2005 (JP) ..... 2005-314747

(51) Int. Cl.
*H01H 19/00* (2006.01)

(52) U.S. Cl. ..... 200/6 R; 338/162

(58) Field of Classification Search ..... 200/6 R, 200/11 A; 338/29, 71, 73, 74, 117, 114, 338/165, 127, 150, 160, 162
See application file for complete search history.

(56) References Cited

U.S. PATENT DOCUMENTS 4,520,306 A * 5/1985 Kirby ..... 323/324
7,173,236 B2 * 2/2007 Kawano et al. ..... 250/231.13

FOREIGN PATENT DOCUMENTS

JP 2003-306149 10/2003
JP 3530764 3/2004

* cited by examiner

*Primary Examiner*—Renee S Luebke
*Assistant Examiner*—Sean Kayes
(74) *Attorney, Agent, or Firm*—Staas & Halsey LLP

(57) ABSTRACT

An input device includes an operation portion, a holding portion, a detection portion and at least a switch. The holding portion holds the operation portion so that the operation portion is rotatable around a given axis. The detection portion detects a rotational position of the operation portion with respect to the holding portion. A condition of the switch changes according to an external force exerted to the operation portion.

18 Claims, 20 Drawing Sheets

INPUT DEVICE AND ELECTRONICS DEVICE

BACKGROUND OF THE INVENTION

1. Field of the Invention

This invention generally relates to an input device which can be applied to an electronics device such as a mobile terminal device like a cellular phone or a PDA (Personal Digital Assistance), a personal computer, an electrical component of a car, or a game machine.

2. Description of the Related Art

There are some types of input devices for an electronics device, as typified by a mouse and so on. Japanese Patent No. 3530764 and Japanese patent Application Publication No. 2003-306149 disclose examples of the input devices. It is necessary to reduce the size or the thickness of the input device in order to apply the input device to a small electronics device.

For example, it is necessary to reduce number of switches or to remove movable portions in order to reduce the size or the thickness of the input device.

However, a function of the input device is decreased and operating feeling is degraded, when the number of switches is reduced or movable portions are removed. That is, an operator can operate the input device easily and can carry out many operations with the input device, if there are as many as switch functions and rotary portions.

SUMMARY OF THE INVENTION

The present invention provides an input device that has multiple functions, has high operability and has small thickness and size.

According to an aspect of the present invention, preferably, there is provided an input device including an operation portion, a holding portion, a detection portion and at least a switch. The holding portion holds the operation portion so that the operation portion is rotatable around a given axis. The detection portion detects a rotational position of the operation portion with respect to the holding portion. A condition of the switch changes according to an external force exerted to the operation portion.

In accordance with the present invention, operability of the input device is improved because the operation portion is rotatable. And it is possible to operate multiple functions with the input device because a signal is output from the switch and the detection portion.

According to another aspect of the present invention, preferably, there is provided an input device including an operation portion, a holding portion, and a detection portion. The holding portion holds the operation portion so that the operation portion is rotatable around a given axis. The detection portion detects a rotational position of the operation portion with respect to the holding portion. At least a part of the detection portion is provided on a facing surface of the operation portion and on a facing surface of the holding portion. The facing surfaces face to each other.

In accordance with the present invention, the input device is downsized and particularly the thickness of the input device is reduced, because the detection portion is provided on the facing surfaces of the operation portion and the holding member.

According to another aspect of the present invention, there is provided an electronics device including an operation portion, a holding portion, and a detection portion. The holding portion holds the operation portion so that the operation portion is rotatable around a given axis. The detection portion detects a rotational position of the operation portion with respect to the holding portion. At least a part of the detection portion is provided on a facing surface of the operation portion and on a facing surface of the holding portion. The facing surfaces face to each other.

BRIEF DESCRIPTION OF THE DRAWINGS

Preferred embodiments of the present invention will be described in detail with reference to the following drawings, wherein.

DESCRIPTION OF THE PREFERRED EMBODIMENTS

A description will now be given with reference to accompanying drawings, of embodiments of an input device in accordance with the present invention.

Figure 1:
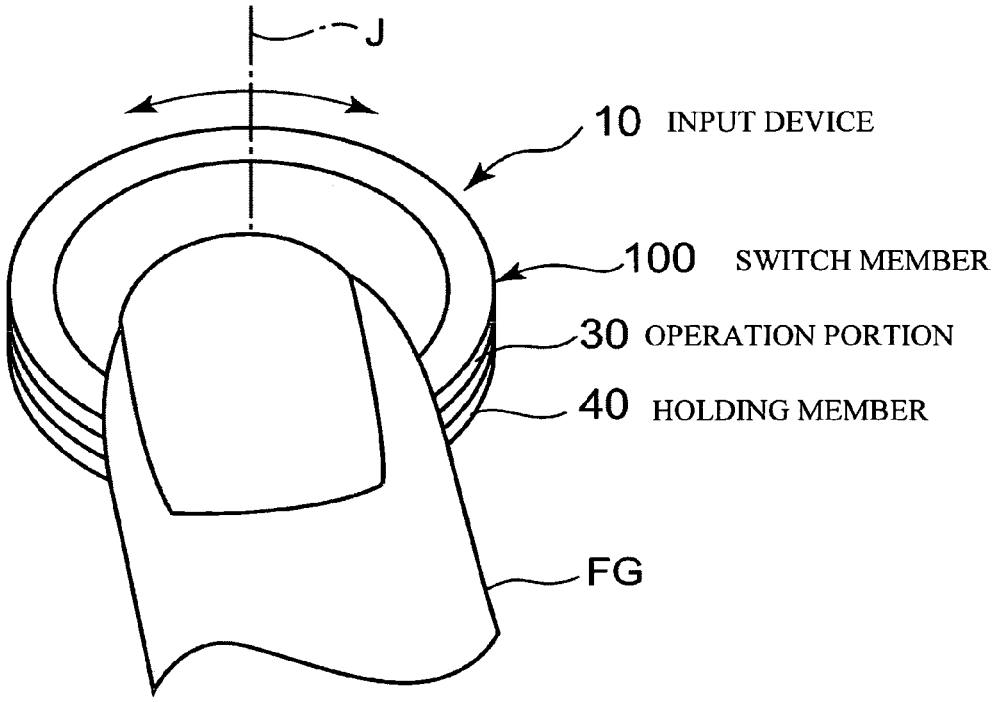
FIG. 1 illustrates an external perspective view of an input device in accordance with an embodiment.
Figure 2:
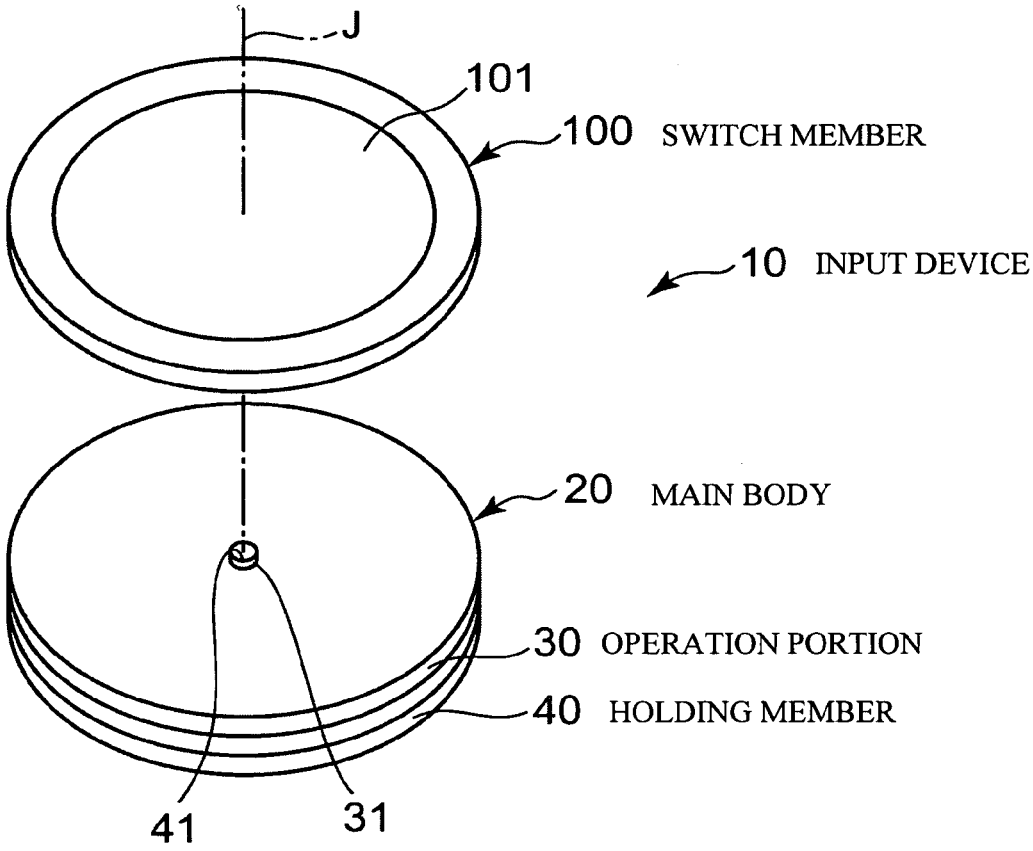
FIG. 2 illustrates an exploded perspective view of an input device shown in FIG. 1.
Figure 3:
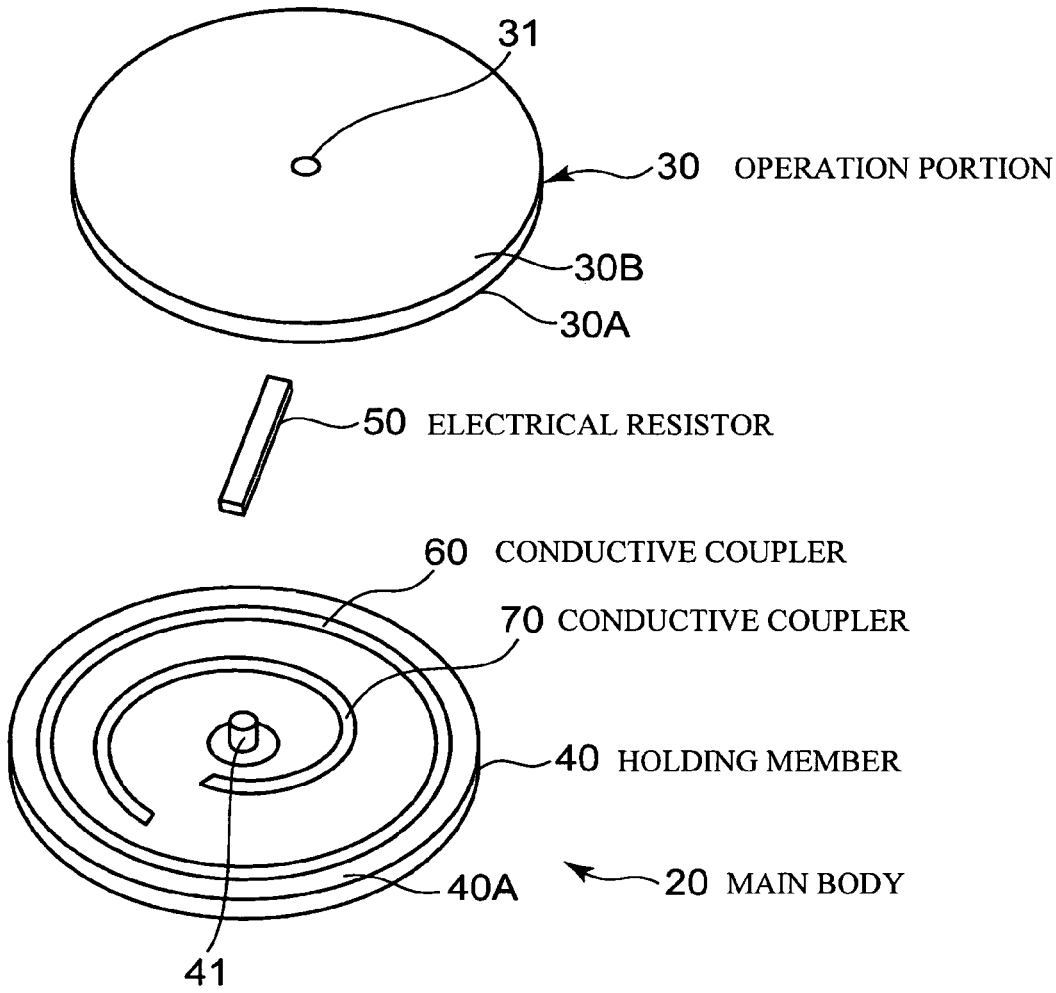
FIG. 3 illustrates an exploded perspective view of a main body of an input device.
Figure 4:
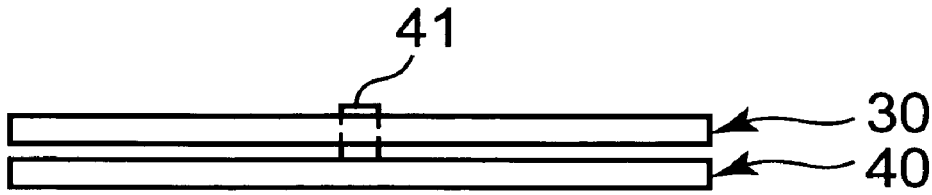
FIG. 4 illustrates a side view of a main body of an input device.
Figure 5:
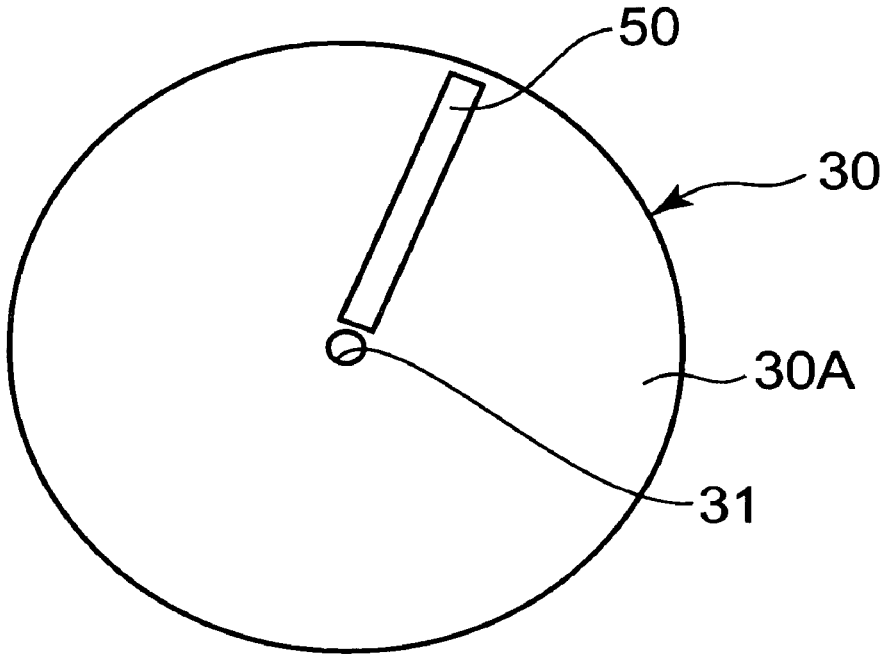
FIG. 5 illustrates a top view of a facing surface of an operation body.
Figure 6:
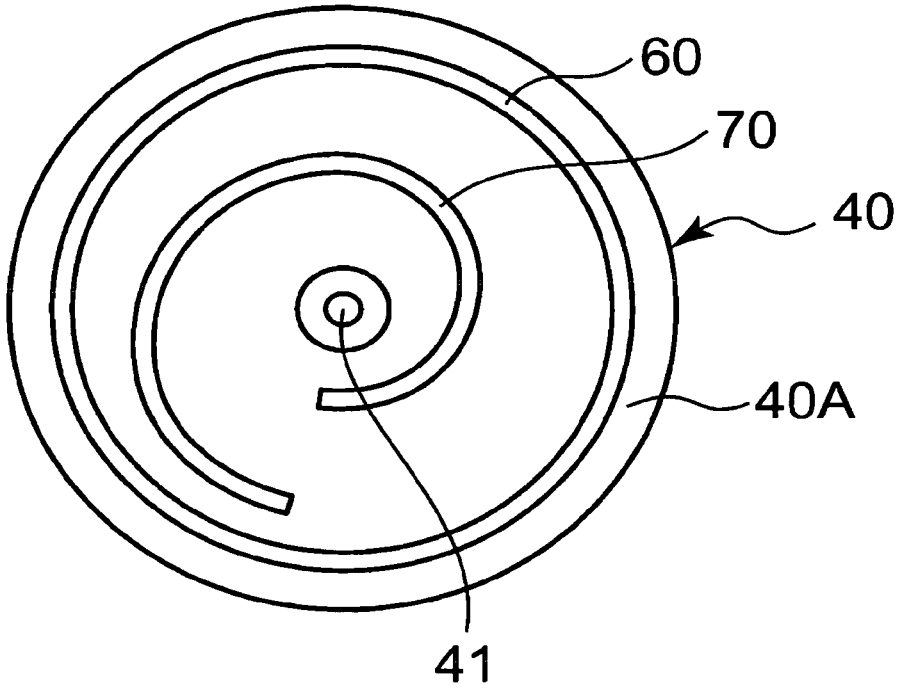
FIG. 6 illustrates a top view of a facing surface of a holding member.
Figure 7A:
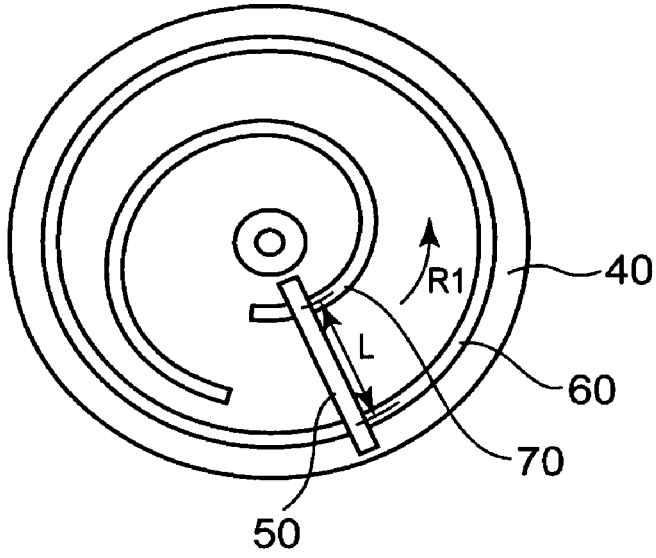
FIG. 7A and FIG. 7B illustrates an action of a resistance-variable-type of a detection portion of a rotational position.
Figure 7B:
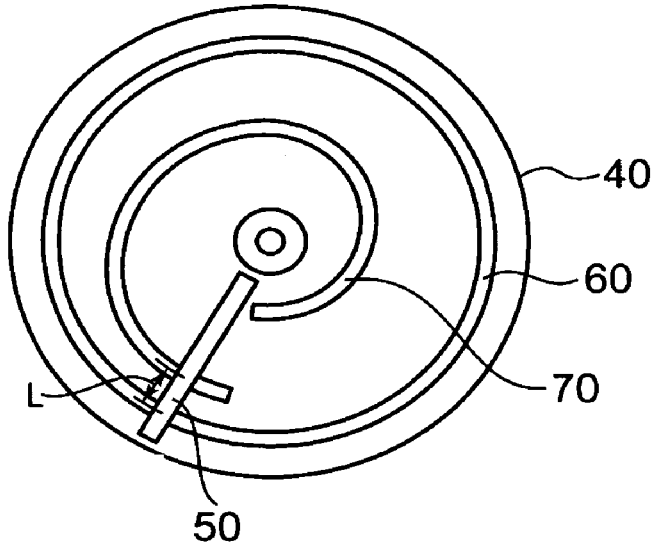
Figure 8:
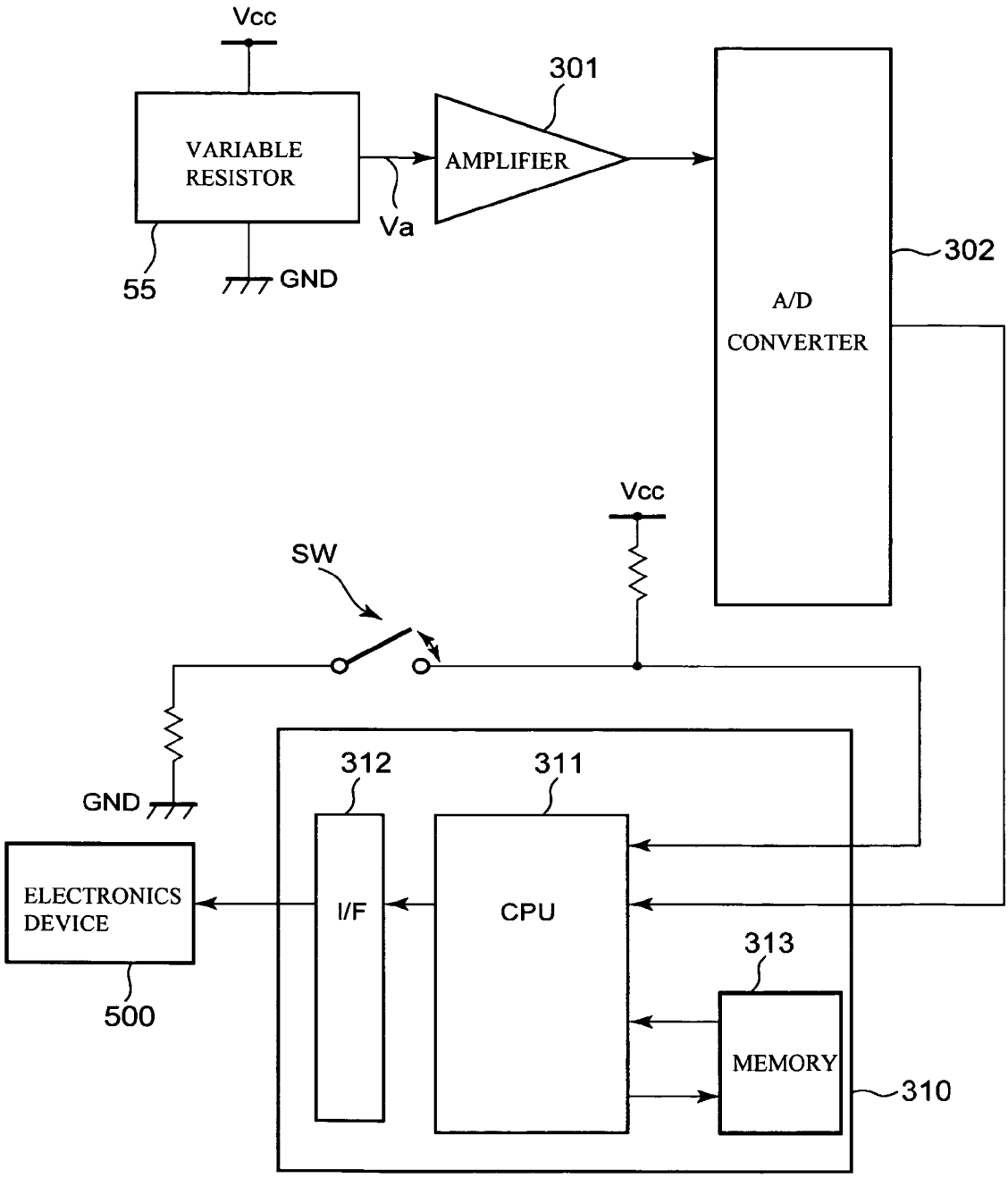
FIG. 8 illustrates a functional block diagram of an electrical structure example of an. input device.
Figure 9:
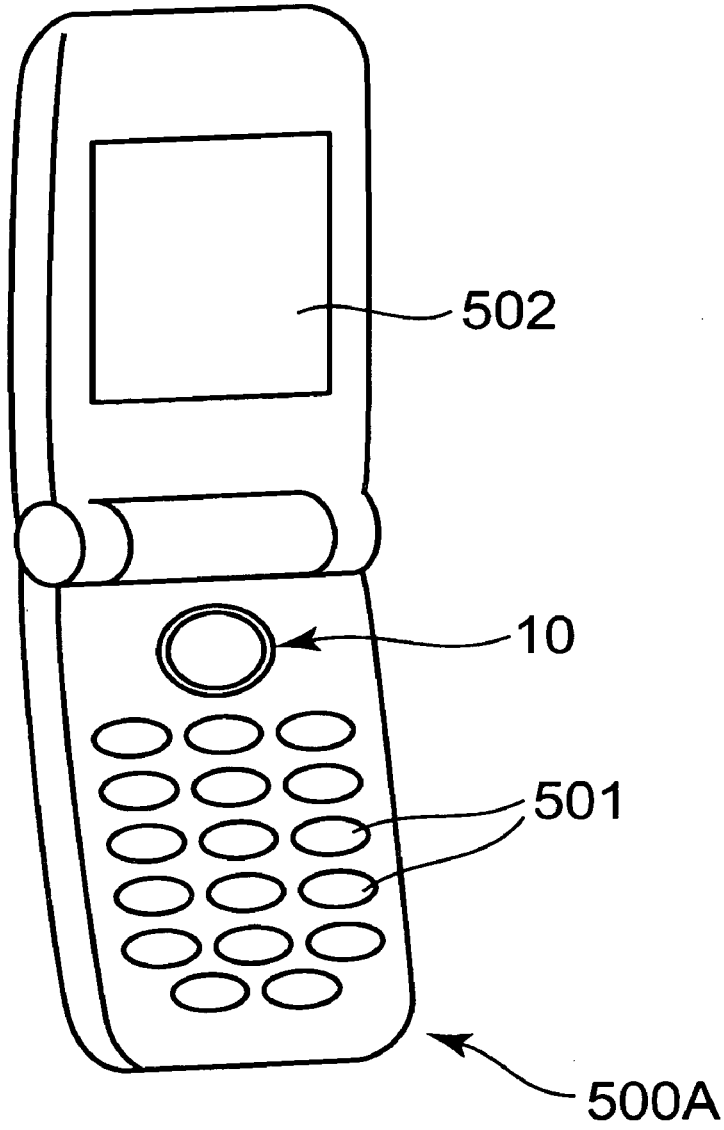
FIG. 9 illustrates a perspective view of a cellular phone as an electronics device to which an input device is applied.

A description will be given, with reference to FIG. 1 through FIG. 9, of an input device in accordance with an embodiment of the present invention. FIG. 1 illustrates an external perspective view of the input device operated by an operator. FIG. 2 illustrates an exploded perspective view of the input device shown in FIG. 1. FIG. 3 illustrates an exploded perspective view of a main body of the input device. FIG. 4 illustrates a side view of the main body of the input device. FIG. 5 illustrates a top view of a facing surface of an operation portion. FIG. 6 illustrates a top view of a facing surface of a holding member. FIG. 7A and FIG. 7B illustrate an action of a resistance-variable-type of a detection portion of a rotational position. FIG. 8 illustrates a functional block diagram of an electrical structure example of the input device. FIG. 9 illustrates a perspective view of a cellular phone as an electronics device to which the input device is applied.

As shown in FIG. 1 and FIG. 2, an input device 10 has a main body 20, a switch member 100 and so on.

The main body 20 has an operation portion 30, a holding member 40, an electrical resistor 50, a conductive coupler 60 as a first conductive coupler, and a conductive coupler 70 as a second conductive coupler. The operation portion 30 and the holding member 40 are made of an electrically insulating material such as a resin, and are formed to be a disk. The electrical resistor 50 is formed on a facing surface 30A of the operation portion 30 facing to the holding member 40. The conductive couplers 60 and 70 are formed on a facing surface 40A of the holding member 40 facing to the operation portion 30.

A through-hole 31, in which a support shaft 41 of the holding member 40 is inserted, is formed at the center of the operation portion 30, as shown in FIG. 2 through FIG. 5. When the support shaft 41 is inserted into the through-hole 31, the operation portion 30 is held by the holding member 40 so as to be rotatably around an axis J. It is, therefore, possible to rotate the operation portion 30 in an optional direction with an operation by a finger FG, as shown in FIG. 1.

The support shaft 41 projects from the center of the holding member 40, as shown in FIG. 3, FIG. 4 and FIG. 6. The operation portion 30 is held by the holding member 40 so as to be rotatably around the support shaft 41. The holding member 40 is fixed to an electronics device to which the input device is applied. The holding member 40 may be a part of the electronics device to which the input device is applied.

The electrical resistor 50 is formed linear, as shown in FIG. 3 and FIG. 5. For example, the electrical resistor 50 is made of such as carbon resistor or a ceramics resistor extending linearly along a radial direction from center of the facing surface 30A of the operation portion 30.

The conductive couplers 60 and 70 are made of such as copper pattern or an aluminum pattern. The conductive coupler 60 is formed along a circumference of a circle around the support shaft 41 on the facing surface 40A of the holding member 40. The conductive coupler 70 has a spiral shape inside of the conductive coupler 60.

The electrical resistor 50 and the conductive couplers 60 and 70 are in touch with each other and are connected electrically, when the support shaft 41 is inserted into the through-hole 31 and the operation portion 30 is held by the holding member 40.

Here, a connecting points of the electrical resistor 50 and the conductive couplers 60 and 70 change as shown in FIG. 7A and FIG. 7B, when the operation portion 30 rotates around the axis J.

A distance L between the connecting points of the conductive couplers 60 and 70 the electrical resistor 50 gets lower and lower, when the operation portion 30 rotates in a direction R1 from a position shown in FIG. 7A. An electrical resistance between the conductive couplers 60 and 70 changes sequentially, when the distance L changes. It is, therefore, possible to detect a rotational position of the operation portion 30, when a change amount of the electrical resistance is converted and detected. That is, the electrical resistor 50 and the conductive couplers 60 and 70 configure a resistance-variable-type of a detection portion of a rotational position.

The switch member 100 is fixed to a surface 30B of the operation portion 30, as shown in FIG. 1. The switch member 100 configures a switch SW mentioned later of which condition changes when the finger FG contacts to an operation surface 101 of the switch member 100 or presses the surface 101 as an external pressure. Particularly, the switch member 100 is of a capacitance type or a resistive film type.

An electrical system of the input device 10 has, for example, a variable resistor 55, an amplifier 301, an A/D converter 302, a switch SW, a processor unit 310 and so on, as shown in FIG. 8.

The variable resistor 55 has the electrical resistor 50 and the conductive couplers 60 and 70. One of the conductive couplers 60 and 70 is coupled to an electrical power supply Vcc. The other is coupled to a grand GND. A voltage Va in a case where the electrical resistor 50 is positioned at a given position is output to the amplifier 301. The voltage Va changes according to the change of the electrical resistance between the conductive couplers 60 and 70.

The amplifier 301 amplifies the voltage Va by a given gain and outputs the amplified voltage to the A/D converter 302. The A/D converter 302 converts an analog signal into a digital signal, and outputs the digital signal to the processor unit 310.

The switch SW has the switch member 100 mentioned-above and is coupled electrically to the processor unit 310. For example, a current is provided to the switch SW when the switch member 100 is pressed to the operation portion 30. And the current is not provided to the switch SW when the switch SW is relaxed.

The processor unit 310 has a processor (CPU) 311, an interface circuit 312, a memory 313 and so on. The interface circuit 312 outputs a data to an electronics device 500. The memory 313 stores a program for creating information to be fed into the electronics device 500. The processor 311 executes the program stored in the memory 313, and creates an input-code (input-information) to be fed into the electronics device 500, according to a data from the A/D converter 302 and a line connection status of the switch SW. The processor 311 outputs the input-code to the electronics device 500 through the interface circuit 312. Other method for creating the input-information may be adopted.

The input device 10 is, for example, applied to such as a cellular phone, as shown in FIG. 9. A cellular phone 500A shown in FIG. 9 is a type of portfolio having a display 502 made of a liquid crystal panel and an operation portion including buttons 501. The input device 10 is provided at upper side of the operation portion.

For example, an operator of the cellular phone 500A can move a pointer displayed on the display 502 to a desirable position and can operate desirably, when the operator rotates the operation portion 30 of the input device 10 and presses the switch member 100.

Figure 10:
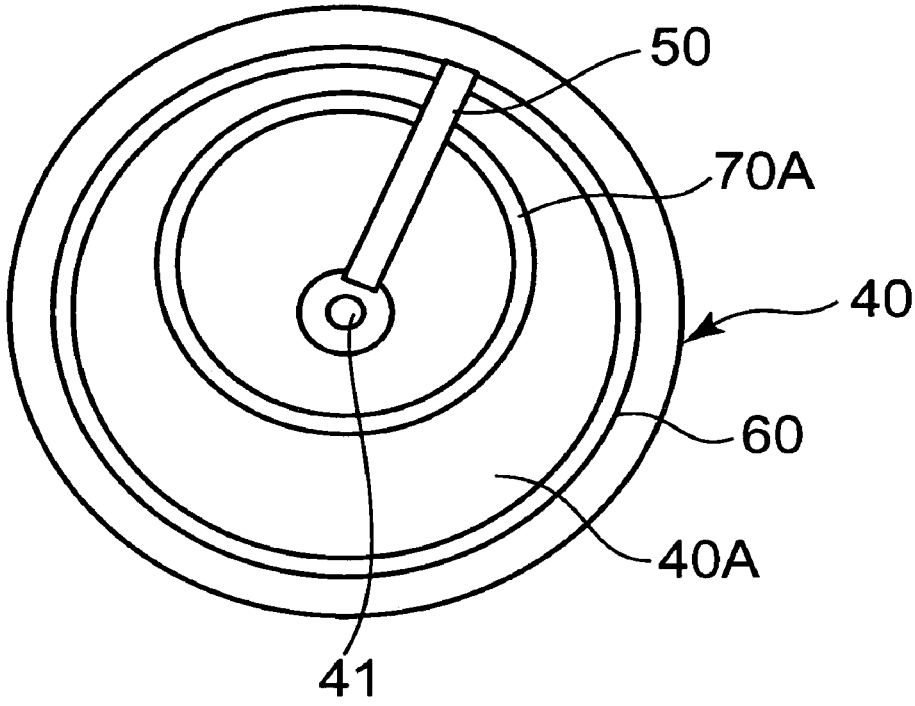
FIG. 10 illustrates a top view of another resistance-variable-type of a detection portion of a rotational position.

FIG. 10 illustrates a top view of another resistance-variable-type of a detection portion of a rotational position. The same components have the same reference numerals in order to avoid a duplicated explanation.

Being different from the conductive coupler 70, a conductive coupler 70A as the second conductive coupler shown in FIG. 10 is formed circular having a given radius. And a center of the circle is shifted with respect to the center (support shaft 41) of the facing surface 40A of the holding member 40.

It is, therefore, possible to form the conductive coupler 70A easily. And it is possible to sequentially change the electrical resistance between the conductive couplers 60 and 70 according to the rotation of the operation portion 30. An electrical system of the input device may be as same as that mentioned above.

Next, a description will be given of an input device in accordance with another embodiment, with reference to FIG. 11 and FIG. 12.

Figure 11:
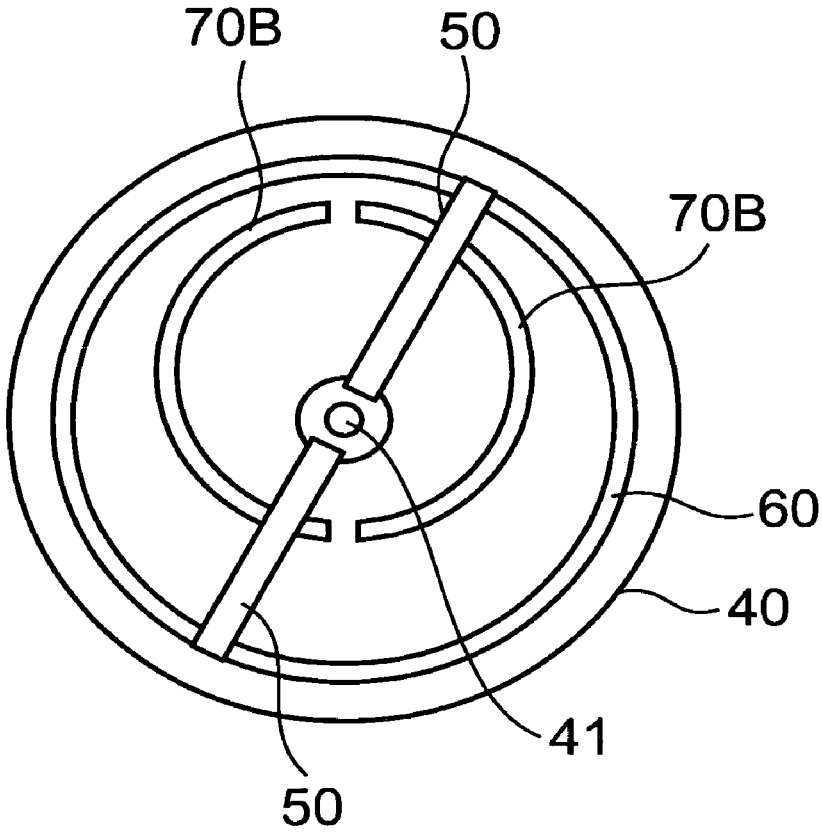
FIG. 11 illustrates a top view of a resistance-variable-type of detection portion of a rotational position in accordance with another embodiment.

FIG. 11 illustrates a top view of a resistance-variable-type of detection portion of a rotational position in accordance with the embodiment. FIG. 12 illustrates a functional block diagram of an electrical configuration of an input device including the detection portion of a rotational position shown in FIG. 11. The same components have the same reference numerals in order to avoid a duplicated explanation.

Two conductive couplers 70B are provided separately on a circumference of which center is shifted with respect to the center (support shaft 41) of the facing surface 40A of the holding member 40.

The electrical resistor 50 is provided on the facing surface 30A of the operation portion 30 (not shown) corresponding to the conductive couplers 70B, and is extending along the diameter direction of the operation portion 30.

Therefore, an electrical resistance between one of the conductive couplers 70B and the conductive coupler 60 is different from that between the other conductive coupler 70B and the conductive coupler 60. And one of the electrical resistances is reduced when the other one is enlarged because of the rotation of the operation portion 30. It is possible to detect the rotational position of the operation portion 30 with high accuracy, when the electrical resistances are converted into electrical signals and a differential between the signals is calculated.

Figure 12:
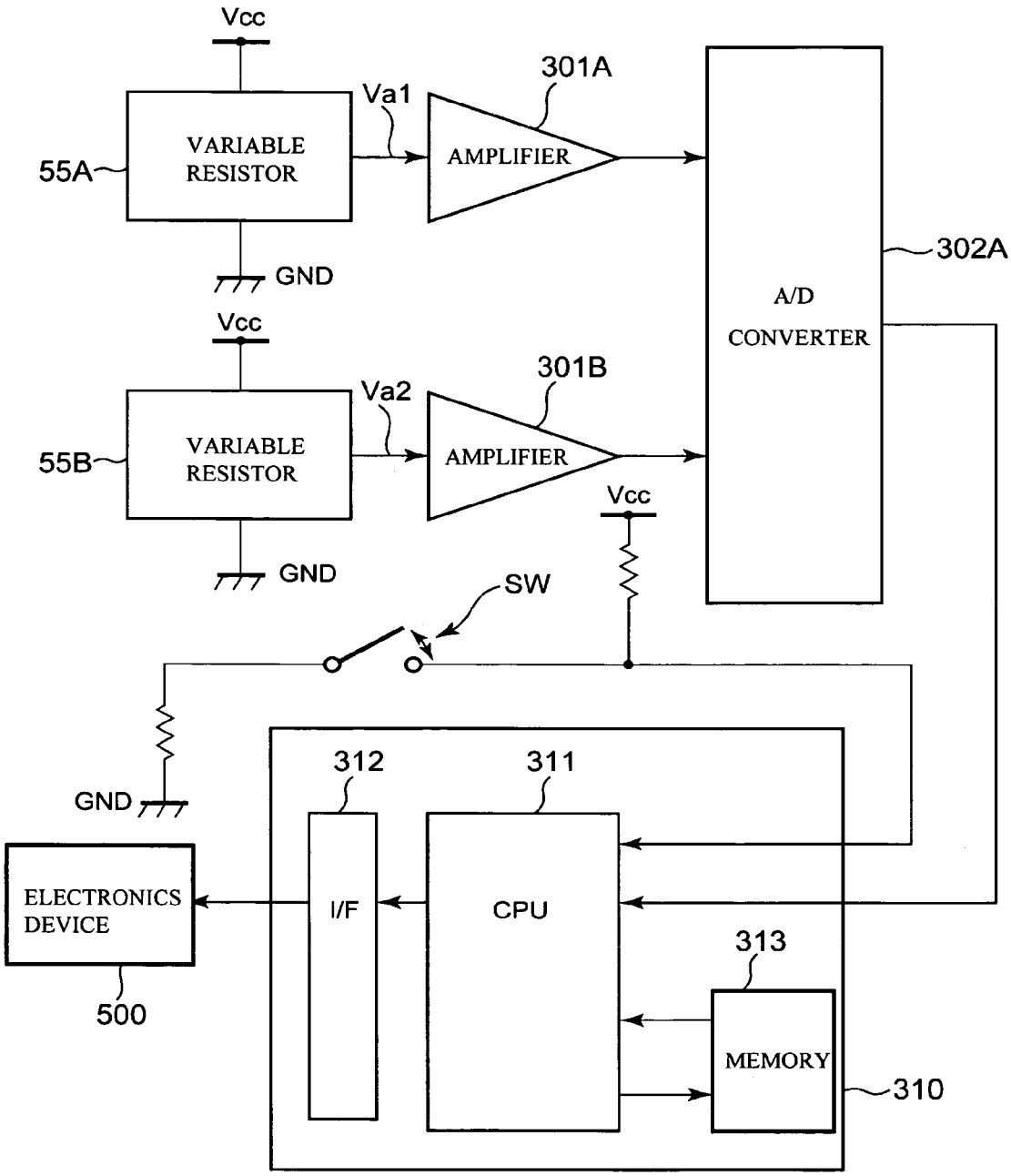
FIG. 12 illustrates a functional block diagram of an electrical configuration of an input device including a detection portion of a rotational position shown in FIG. 11.

An electrical system of the input device is shown in FIG. 12. That is, the conductive coupler 60, two conductive couplers 70B and two electrical resistors 50 configure variable resistors 55A and 55B.

The variable resistors 55A and 55B output voltages Va1 and Va2. The voltages are amplified by amplifiers 301A and 301B respectively and are fed into an A/D converter 302A. The A/D converter 302A outputs digital signals of the voltages Va1 and Va2 to the processor unit 310. The processor unit 310 creates an input-information to the electronics device 500 according to the voltages Va1 and Va2 and the condition of the switch SW.

Figure 13:
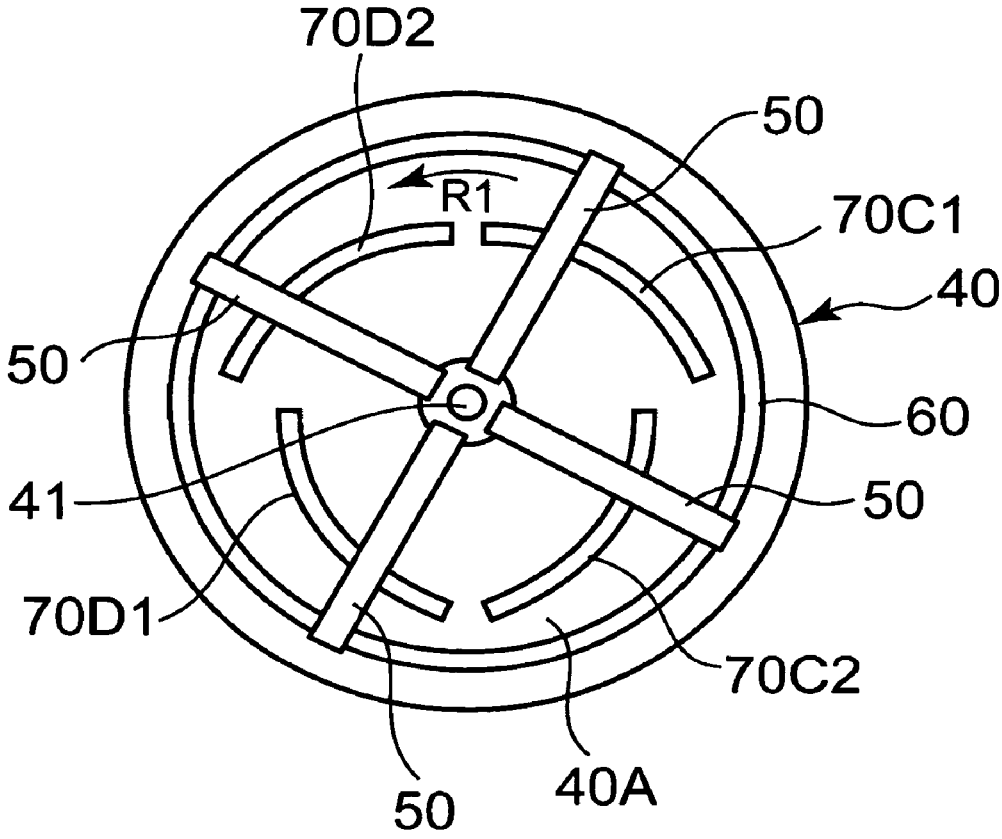
FIG. 13 illustrates a top view of a resistance-variable-type of a detection portion of a rotational position in accordance with another embodiment.

FIG. 13 illustrates a top view of a resistance-variable-type of a detection portion of a rotational position in accordance with another embodiment. The same components have the same reference numerals in order to avoid a duplicated explanation.

As shown in FIG. 13, conductive couplers 70C1, 70C2, 70D1 and 70D2 are provided on the facing surface 40A of the holding member 40. A plurality of electrical resistors 50 are provided on the facing surface 30A of the operation portion 30 (not shown). Each of the electrical resistors 50 is provided corresponding to each of the conductive couplers 70C1, 70C2, 70D1 and 70D2.

Electrical resistances between the conductive couplers 60 and 7OC1 and between the conductive coupler 60 and 70C2 are enlarged and electrical resistances between the conductive coupler 60 and 70D1 and between the conductive couplers 60 and 70D2 are reduced, when the operation portion 30 rotates in a direction R1. It is, therefore, possible to detect the rotational position and the rotational direction of the operation portion 30 with high accuracy, by using a change of the electrical resistances.

Figure 14:
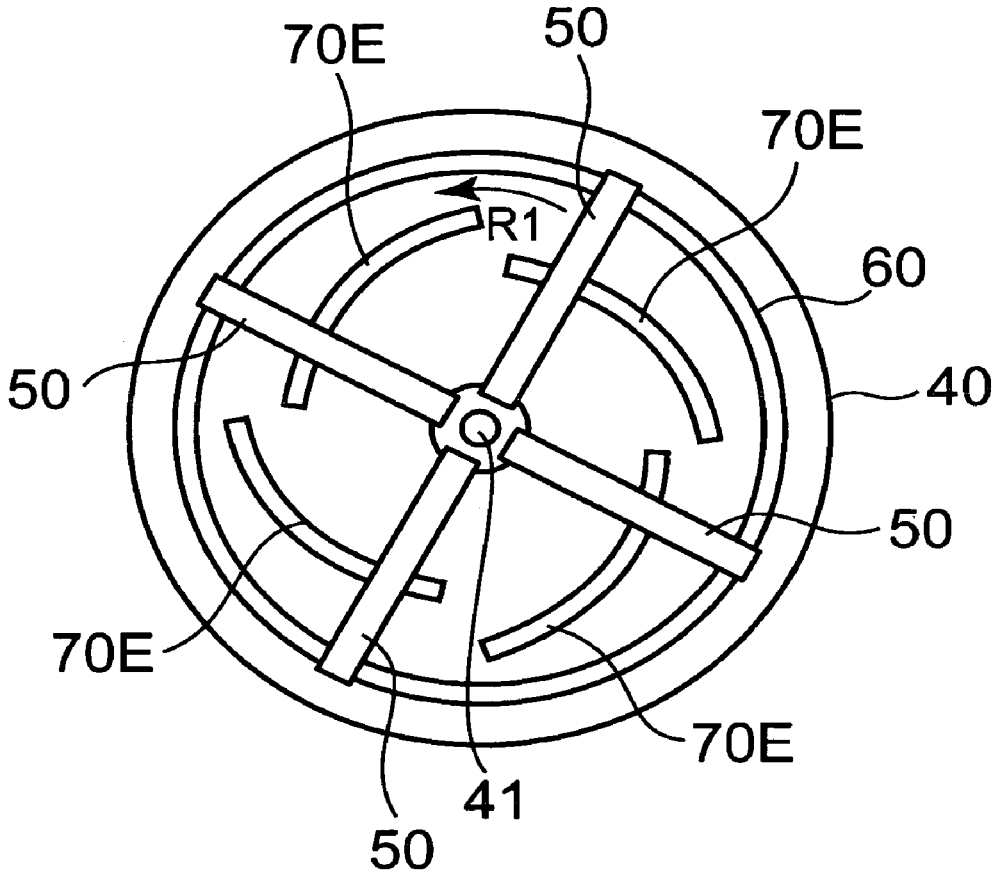
FIG. 14 illustrates another example of a resistance-variable-type of a detection portion of a rotational position.

FIG. 14 illustrates another example of a resistance-variable-type of a detection portion of a rotational position. The same components have the same reference numerals in order to avoid a duplicated explanation.

Four conductive couplers 70E are arranged at even intervals in a circumferential direction on the facing surface 40A of the holding member 40, as shown in FIG. 14. Four electrical resistors 50 are arranged respectively corresponding to each of the conductive couplers 70E on the facing surface 30A of the operation portion 30 (not shown).

Each of the electrical resistances between the conductive coupler 60 and the four conductive couplers 70E is enlarged, when the operation portion 30 rotates in the direction R1. For example, it is possible to detect the rotational position of the operation portion 30 with high accuracy, by calculating an average of the electrical resistances.

A description will be given of an input device in accordance with another embodiment of the present invention, with reference to FIG. 15 and FIG. 16. The same components have the same reference numerals in order to avoid a duplicated explanation. The input device in accordance with the embodiment does not have the switch member 100 mentioned above.

Figure 15:
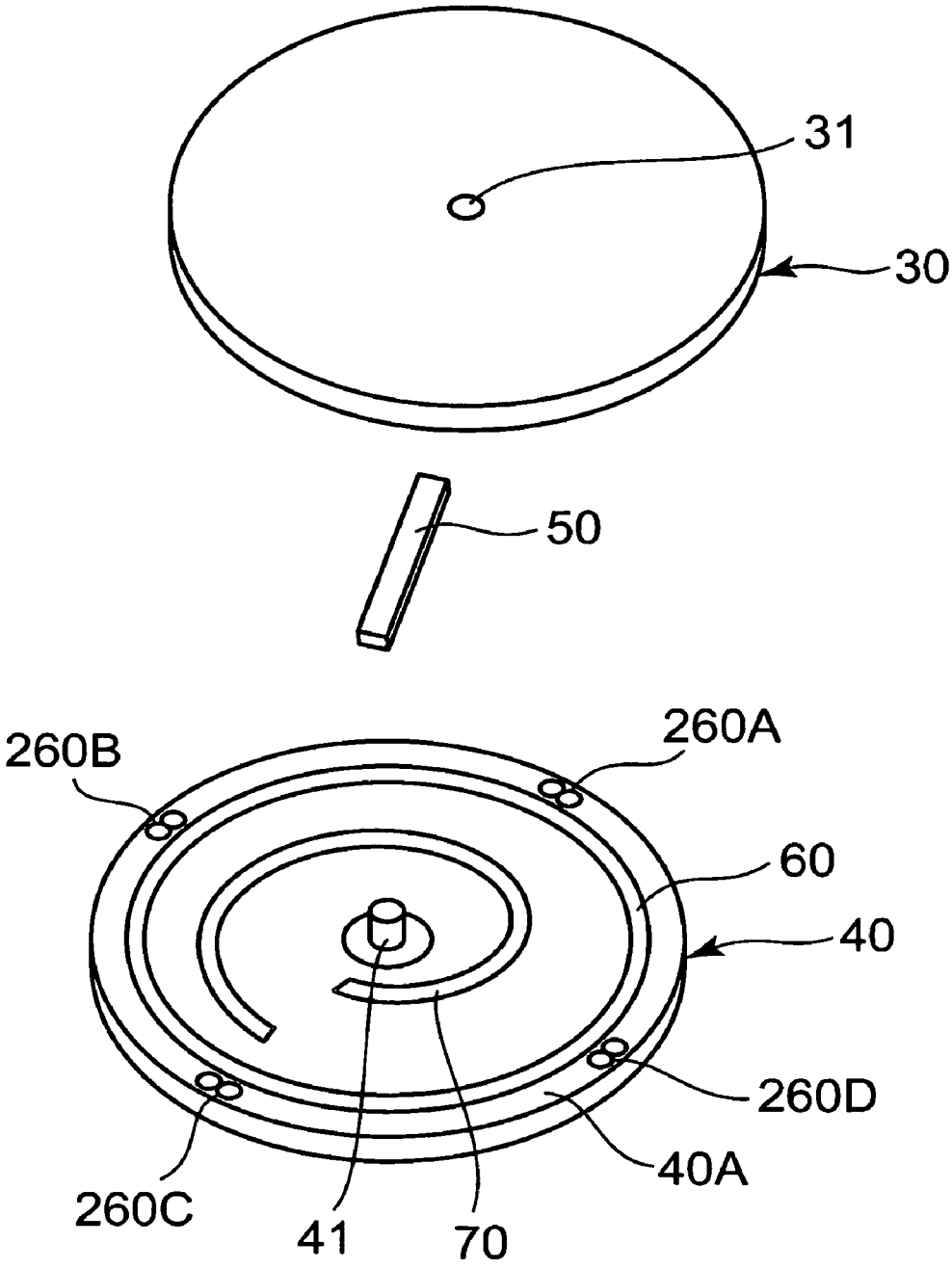
FIG. 15 illustrates an exploded perspective view of an input device in accordance with another embodiment.

As shown in FIG. 15, a plurality of contact members 260A through 260D are arranged at even intervals along a circumference of the facing surface 40A of the holding member 40, the contact members having a projection shape. The contact members 260A through 260D are made of a metal such as copper and aluminum or a carbon. The contact members 260A through 260D are coupled electrically to the grand GND.

Figure 16:
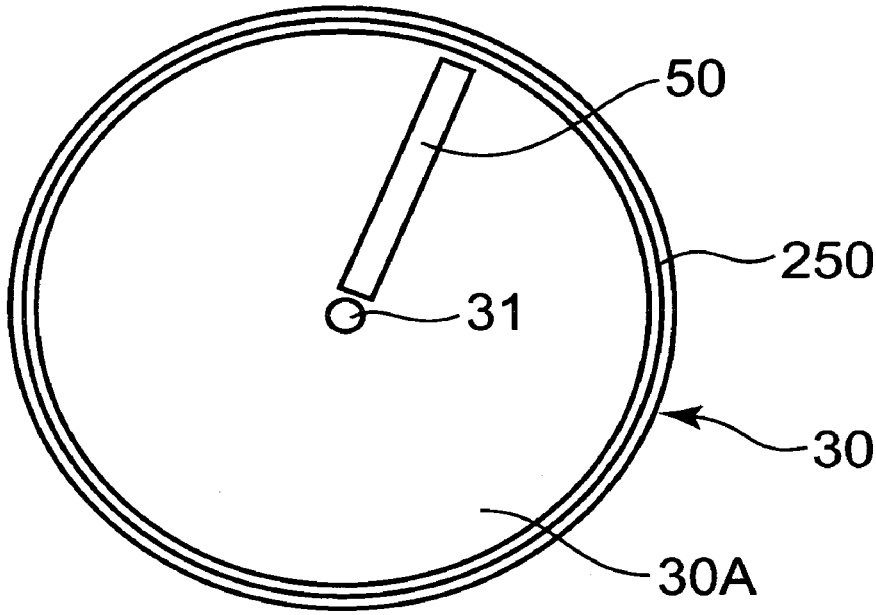
FIG. 16 illustrates a top view of a facing surface of an operation portion.

On the other hand, a conductive coupler 250 is provided on the circumference of the facing surface 30A of the operation portion 30 as shown in FIG. 16, the conductive coupler 250 having a ring shape. The conductive coupler 250 is made of such as a copper pattern or an aluminum pattern, and is, for example, coupled electrically to the processor unit 310.

The contact members 260A through 260D and the conductive coupler 250 are arranged facing so as to be electrically contactable to each other, and configure a switch.

One of the contact members 260A through 260D is coupled to the conductive coupler 250, when the operation portion 30 is under a force so as to incline.

All of the contact members 260A through 260D may be coupled to the conductive coupler 250 when the operation portion 30 is pressed.

The operation portion 30 may be elastically deformable, and one of the contact members 260A through 260D is coupled electrically to the conductive coupler 250 when the operation portion deforms with a force of a finger.

As mentioned above, the switch including the contact members 260A through 260D and the conductive coupler 250 is provided on the facing surface 30A of the operation portion 30 and on the facing surface 40A of the holding member 40. And it is possible to reduce the thickness of the input device and to generate various signals with various operations to the operation portion 30.

A description will be given of an input device in accordance with another embodiment of the present invention, with reference to FIG. 17 through FIG. 20B.

Figure 17:
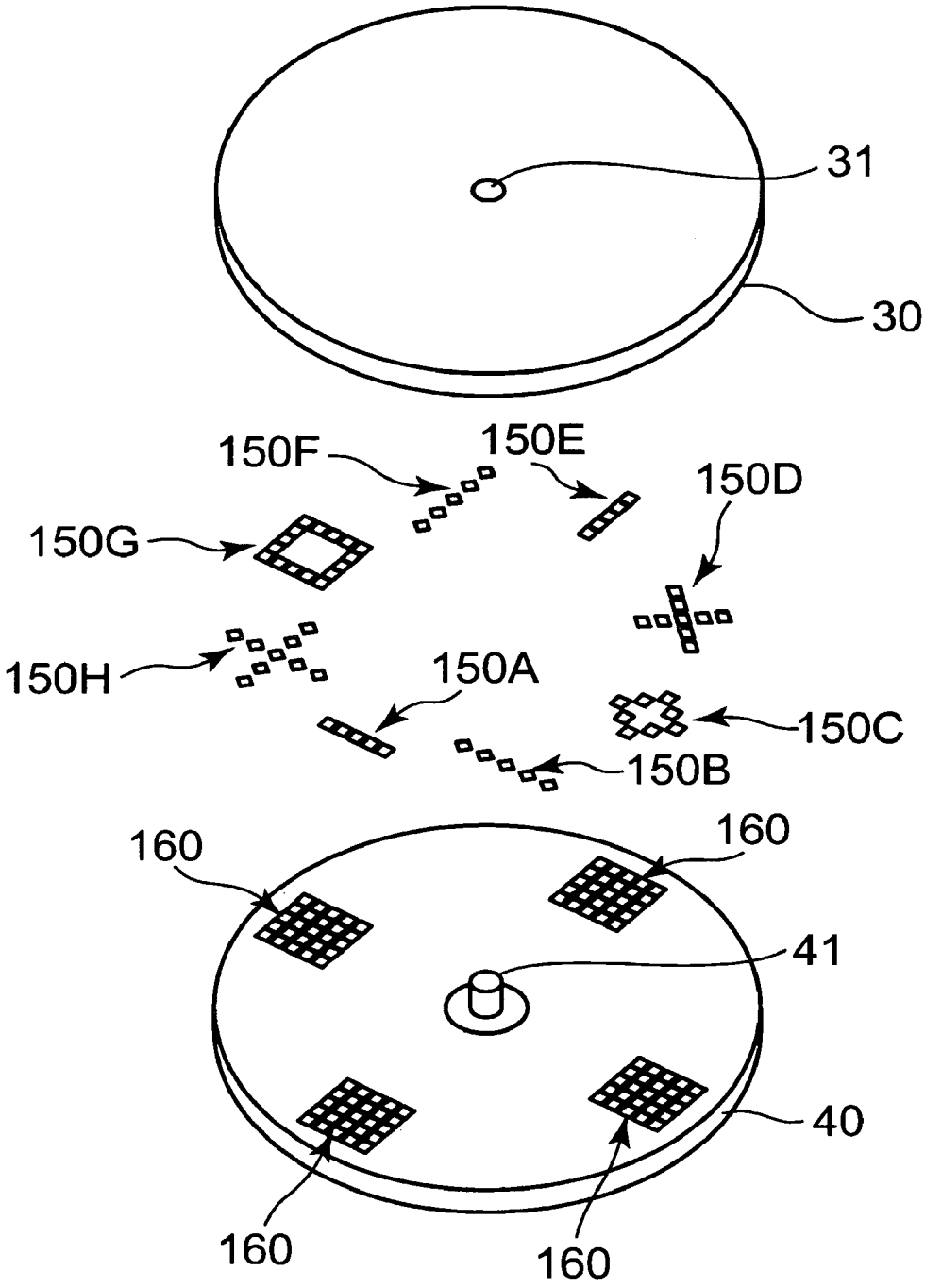
FIG. 17 illustrates an exploded perspective view of an input device in accordance with another embodiment.
Figure 18:
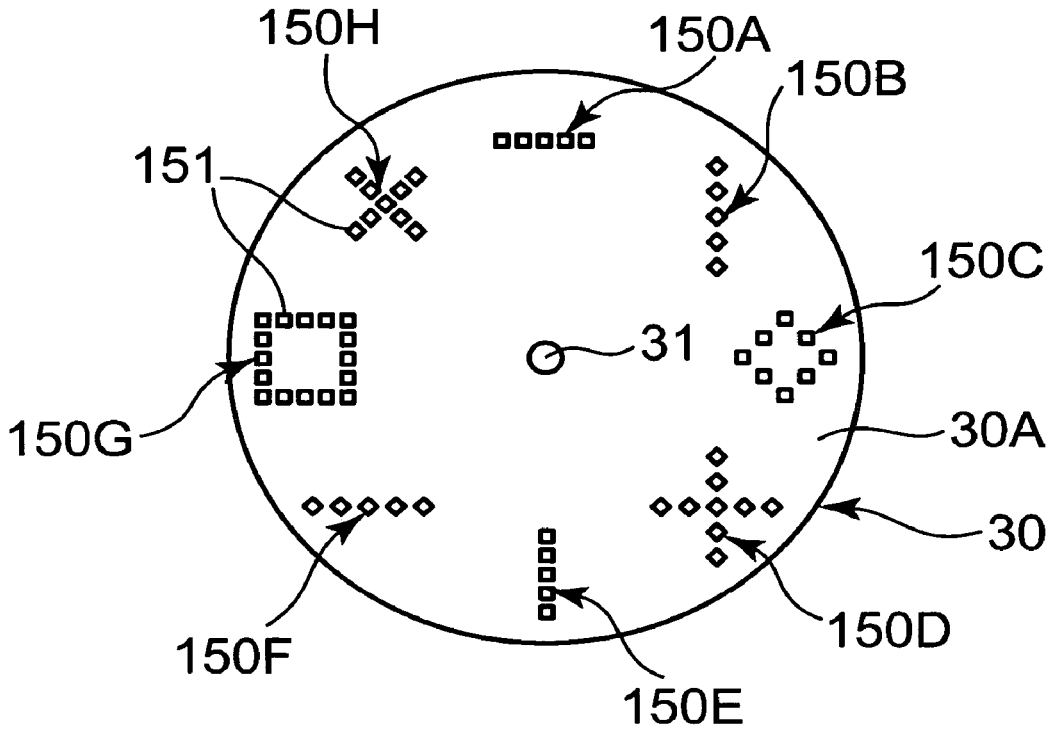
FIG. 18 illustrates a top view of a facing surface of an operation portion.
Figure 19:
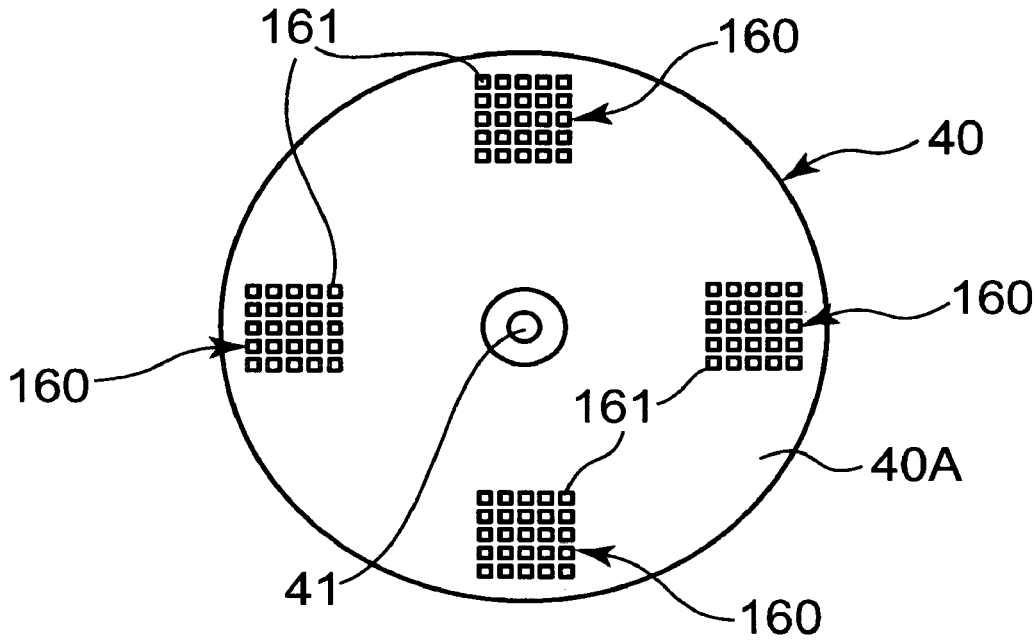
FIG. 19 illustrates a top view of a facing surface of a holding member.
Figure 20A:
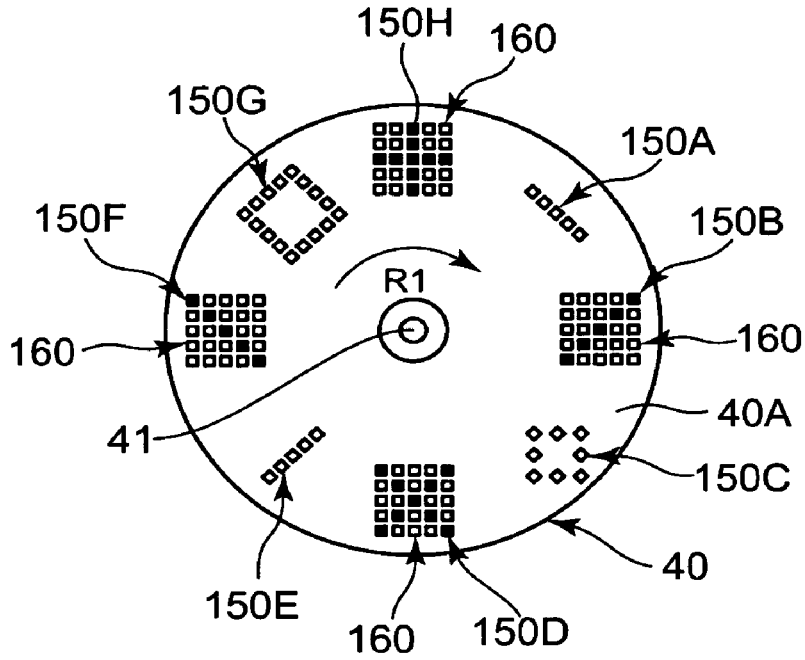
FIG. 20A and FIG. 20B illustrate an action of a detection portion of a rotational position.
Figure 20B:
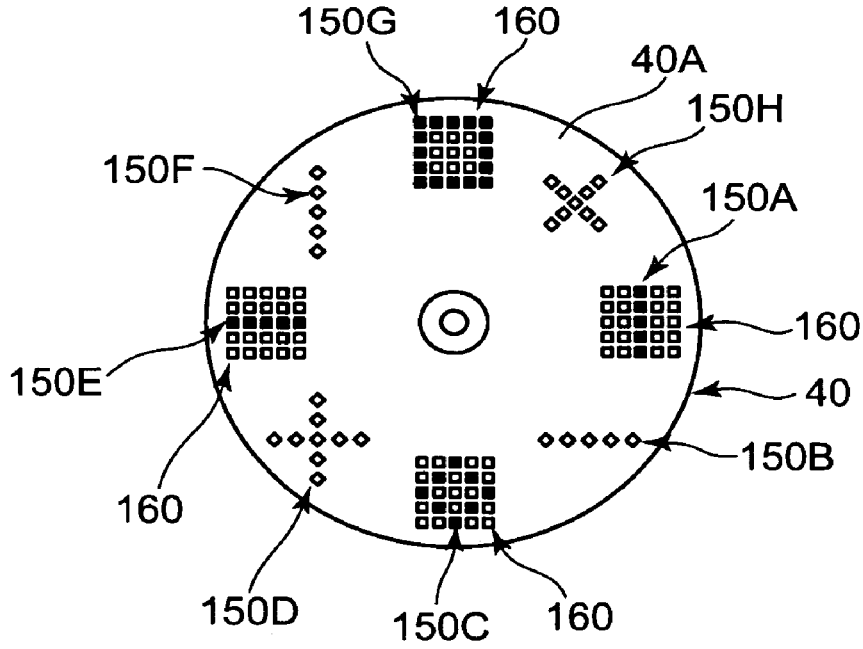

FIG. 17 illustrates an exploded perspective view of the input device in accordance with the embodiment of the present invention. FIG. 18 illustrates a top view of the facing surface of the operation portion. FIG. 19 illustrates a top view of the facing surface of the holding member. FIG. 20A and FIG. 20B illustrate an action of the detection portion of a rotational position. The same components have the same reference numerals in order to avoid a duplicated explanation, in FIG. 17 through FIG. 20B.

The input device has contact patterns 150A through 150H on the facing surface 30A of the operation portion 30, instead of the electrical resistor 50 and the conductive couplers 60 and 70, as shown in FIG. 18. The input device has contact patterns 160 on the facing surface 40A of the holding member 40, as shown in FIG. 17 and FIG. 19. The contact patterns 150A through 150H and the contact patterns 160 are arranged to be electrically contactable to each other according to the rotation of the operation portion 30.

As shown in FIG. 18, the contact patterns 150A through 150H have electrical contacts 151 arranged in various patterns, and are arranged at substantially even intervals in the circumference direction of the facing surface 30A. The electrical contact 151 is made of a metal such as copper or aluminum or a carbon. Each of the electrical contacts 151 is, for example, coupled to the power supply Vcc.

As shown in FIG. 19, each of the contact patterns 160 has a same pattern configured with electrical contacts 161. There are four contact patterns 160 at substantially even intervals on the circumference direction of the facing surface 40A of the holding member 40. The electrical contact 161 is made of a metal such as copper or aluminum or carbon. Each of the electrical contacts 161 is, for example, coupled to the processor unit 310.

As shown in FIG. 20A, the contact patterns 160 output a signal to the processor unit 310 and the signals through contact patterns 150B, 150D, 15OF and 150H are different from each other, when the contact patterns 150B, 150D, 15OF and 150H are coupled electrically to the contact patterns 160 respectively.

As shown in FIG. 20B, contact patterns 150A, 150C, 150E and 150G are coupled electrically to the contact patterns 160, when the operation portion (not shown) rotates by a given angle in the direction Rl shown in FIG. 20A. In this case, the contact patterns 160 output a signal to the processor unit 310 and the signals through the contact patterns 150A, 150C, 150E and 150G are different from each other and different from those mentioned above. Accordingly, the processor unit 310 can detect the rotational position of the operation portion 30.

The switch member 100 mentioned above and the switch shown in FIG. 15 and FIG. 16 may be provided in the embodiment.

The embodiments mentioned above include but not limited to the case where the operation portion has a disk shape. The operation portion may have other shapes such as a wheel.

The embodiments mentioned above include but not limited to the case where the electrical resistor is provided on the operation portion and the conductive coupler is provided on the holding member. The electrical resistor may be provided on the holding member and the conductive coupler may be provided on the operation portion.

The embodiments mentioned above include but not limited to the case where the electrical resistor is formed linear. The electrical resistor may have other shapes such as a curved shape.

The embodiments mentioned above include but not limited to the case where the first conductive coupler is arranged outside of the second conductive coupler. The first conductive coupler may be arranged inside of the second coupler.

The embodiments mentioned above include but not limited to the case where the input device has the A/D converter, processor unit and so on. These components are provided in the electronics device.

The embodiments mentioned above include but not limited to the case where the contact patterns 150A through 150H are provided on the operation portion 30 and the contact patterns are provided on the holding member 40. The contact patterns 150A through 150H may be provided on the holding member 40 and the contact patterns 160 may be provided on the operation portion 30.

The embodiments mentioned above include but not limited to the case where the cellular phone is described as an electronics device. The input device may be applied to various electronics devices such as a mobile terminal device like a cellular phone or a PDA, a personal computer, an electrical component of a car, or a game machine.

The embodiments mentioned above include but not limited to the case where the detection portion of a rotational position is a type of contact. An optical sensor may detect a rotational position of the operation portion and the holding member without contact.

While the above description constitutes the preferred embodiments of the present invention, it will be appreciated that the invention is susceptible of modification, variation and change without departing from the proper scope and fair meaning of the accompanying claims.

The present invention is based on Japanese Patent Application No. 2005-314747 filed on Oct. 28, 2005, the entire disclosure of which is hereby incorporated by reference.

What is claimed is:

1. An input device comprising:

an operation portion;

a holding portion that holds the operation portion so that the operation portion is rotatable around a given axis;

a detection portion that detects a rotational position of the operation portion with respect to the holding portion and comprising a bar shaped resistor that can be substantially traversed by a contact as rotation occurs; and at least a switch of which condition changes according to an external force exerted on the operation portion.

2. The input device as claimed in claim 1, wherein:

the detection portion has an electrical resistor, a first conductive coupler and a second conductive coupler, the electrical resistor being provided on one of facing surfaces of the operation portion and the holding portion, the first conductive coupler and the second conductive coupler being provided on the other facing surface and being electrically coupled to each other through the electrical resistor; and an electrical resistance between the first conductive coupler and the second conductive coupler changes according to a rotation of the operation portion.

3. The input device as claimed in claim 1, wherein:

the detection portion has a first contact pattern and second contact patterns, the first contact pattern comprising electrical contacts arranged in a given pattern on one of facing surfaces of the operation portion and the holding portion, the second contact patterns comprising a pattern of electrical contacts on the other facing surfaces of the operation portion and the holding portion, the patterns of the electrical contacts being different from each other; and the first contact pattern is coupled electrically to other second contact pattern according to a rotation of the operation portion.

4. The input device as claimed in claim 2, wherein the electrical resistor is formed substantially linear in a radial direction of a circle around the given axis.

5. The input device as claimed in claim 4, wherein one of the first and the second conductive couplers is provided on a circumference of a circle around the given axis and the other has a different shape from the conductive coupler on the circumference.

6. The input device as claimed in claim 1, wherein the operation portion has a disk shape or a wheel shape.

7. An input device comprising:

an operation portion;

a holding portion that holds the operation portion so that the operation portion is rotatable around a given axis; and a detection portion that detects a rotational position of the operation portion with respect to the holding portion and comprising a bar shaped resistor that can be substantially traversed by a contact as rotation occurs, wherein at least a part of the detection portion is provided on a facing surface of the operation portion and on a facing surface of the holding portion, the facing surfaces facing to each other.

8. The input device as claimed in claim 7, wherein:

the detection portion has an electrical resistor, a first conductive coupler and a second conductive coupler, the electrical resistor being provided on one of the facing surfaces of the operation portion and the holding portion, the first conductive coupler and the second conductive coupler being provided on the other facing surface and being electrically coupled to each other through the electrical resistor; and an electrical resistance between the first conductive coupler and the second conductive coupler changes according to a rotation of the operation portion.

9. The input device as claimed in claim 7, wherein:

the detection portion has a first contact pattern and second contact patterns, the first contact pattern comprising electrical contacts arranged in a given pattern on one of the facing surfaces of the operation portion and the holding portion, the second contact patterns comprising a pattern of electrical contacts on the other facing surfaces of the operation portion and the holding portion, the patterns of the electrical contacts being different from each other; and the first contact patterns is coupled electrically to other second contact pattern according to a rotation of the operation portion.

10. The input device as claimed in claim 7 further comprising at least a switch of which condition changes according to a contact or an external force.

11. The input device as claimed in claim 10, wherein the switch is provided on the facing surfaces.

12. The input device as claimed in claim 11, wherein the switch has a contact member and a conductive coupler, the contact member being provided on one of the facing surfaces, the conductive coupler being provided on the other facing surface so as to be contactable to the contact member.

13. The input device as claimed in claim 11, wherein a plurality of switches are arranged on a circumference of a circle around the given axis.

14. The input device as claimed in claim 10, wherein the switch is provided on a surface side of the operation portion.

15. The input device as claimed in claim 14, wherein the switch is of a capacitance type or a resistive film type.

16. An electronics device comprising:

an operation portion;

a holding portion that holds the operation portion so that the operation portion is rotatable around a given axis; and a detection portion that detects a rotational position of the operation portion with respect to the holding portion and comprising a bar shaped resistor that can be substantially traversed by a contact as rotation occurs, wherein at least a part of the detection portion is provided on a facing surface of the operation portion and on a facing surface of the holding portion, the facing surfaces facing to each other.

17. An input device, comprising:

a first disk having formed thereon a bar shaped resistor; and a second disk facing the first disk and having formed thereon patterned conductors for contacting the bar shaped resistor that can be substantially traversed by a contact and producing an output resistance that varies as the first and second disks rotate with respect to each other.

18. An input device, comprising:

a first disk having formed thereon a bar shaped resistor;

a second disk facing the first disk and having formed thereon patterned conductors for contacting the bar shaped resistor that can be substantially traversed by a contact and producing an output resistance that varies as the first and second disks rotate with respect to each other; and a momentary contact switch associated with the first and second disks.

* * * * *